US009416550B2

(12) United States Patent
Walker et al.

(10) Patent No.: US 9,416,550 B2
(45) Date of Patent: Aug. 16, 2016

(54) WORK BENCH SUPPORT BRACKET

(71) Applicant: 761250 ALBERTA LTD., Toronto (CA)

(72) Inventors: Simon Walker, Delta (CA); Hou Jun (Frank) Fan, Surrey (CA); Craig Raymond Lawson, Burnaby (CA); Leonard Earl Koffski, Duncan (CA)

(73) Assignee: 761250 ALBERTA LTD., Toronto (CA)

( * ) Notice: Subject to any disclaimer, the term of this patent is extended or adjusted under 35 U.S.C. 154(b) by 0 days.

(21) Appl. No.: 14/386,580

(22) PCT Filed: Mar. 18, 2013

(86) PCT No.: PCT/CA2013/000240
§ 371 (c)(1),
(2) Date: Sep. 19, 2014

(87) PCT Pub. No.: WO2013/138903
PCT Pub. Date: Sep. 26, 2013

(65) Prior Publication Data

US 2015/0075909 A1 Mar. 19, 2015

(30) Foreign Application Priority Data

Mar. 19, 2012 (CA) ..... 2771466

(51) Int. Cl.
*B25H 1/06* (2006.01)
*E04G 1/32* (2006.01)
(Continued)

(52) U.S. Cl.
CPC .. *E04G 1/32* (2013.01); *B25H 1/06* (2013.01); *B27B 21/00* (2013.01); *E04G 1/15* (2013.01)

(58) Field of Classification Search
CPC ..... B25H 1/06; B25H 1/00; E04G 1/32; E04G 1/15; E04G 1/18; E04G 1/20; B27B 21/00
See application file for complete search history.

(56) References Cited

U.S. PATENT DOCUMENTS 592,574 A * 10/1897 Ring ..... B25H 1/06 182/153
2,891,819 A * 6/1959 Jackson ..... E04G 1/28 182/113

(Continued)

FOREIGN PATENT DOCUMENTS

GB 2023704 A 1/1980

OTHER PUBLICATIONS

International Search Report mailed Jul. 2, 2013, issued by the Canadian Intellectual Property Office for International PCT Patent Application No. PCT/CA2013/000240.

(Continued)

*Primary Examiner* — Daniel Cahn
(74) *Attorney, Agent, or Firm* — Gowling WLG (Canada) LLP

(57) ABSTRACT

A work bench support bracket with first and second opposed, generally upright sockets for receiving wood members is joined to first and second telescopically interconnectible, generally horizontal sockets, respectively. First and second clamping sets are also joined to the first and second generally upright sockets, respectively. Each of the clamping sets comprises an upper releasable chimp and a fixed lower brace member. The upper releasable clamp comprises a grip pivotably attached to the upright socket, a connector extending from the grip, and a handle pivotably connected to the connector. The work bench support bracket provides for the secure attachment of the wood members and reduces the likelihood of an accidental release of the wood members.

19 Claims, 9 Drawing Sheets

(51) Int. Cl.
*E04G 1/15* (2006.01)
*B27B 21/00* (2006.01)

(56) References Cited

U.S. PATENT DOCUMENTS 2,899,011 A * 8/1959 Babits ..... E06C 7/165 182/120
3,036,657 A * 5/1962 Ladue ..... A47B 13/021 182/224
4,134,473 A * 1/1979 Prior ..... E04G 1/34 182/182.4
4,228,871 A * 10/1980 Koffski ..... E04G 1/15 182/182.4
4,296,835 A * 10/1981 Koffski ..... E04G 1/15 182/182.4
4,298,095 A * 11/1981 Jackson ..... B25H 1/06 182/182.4
4,308,934 A * 1/1982 Jackson ..... B25H 1/06 182/182.4
4,502,565 A * 3/1985 Koffski ..... F16M 13/00 182/182.4
4,804,064 A 2/1989 Coultrup et al.
5,020,634 A * 6/1991 Gunderson ..... E04G 1/32 182/182.4
2009/0321563 A1 * 12/2009 Moore ..... B64F 5/0036 244/118.1

OTHER PUBLICATIONS

Written Opinion mailed Jul. 2, 2013, issued by the Canadian Intellectual Property Office for International PCT Patent Application No. PCT/CA2013/000240.
Extended European Search Report dated Mar. 9, 2016, issued by the European Patent Office for corresponding European Patent Application No. 13765077.6.

* cited by examiner

WORK BENCH SUPPORT BRACKET

FIELD OF THE INVENTION

The invention relates to an improved support bracket which may be releasably attached to lumber pieces to form a variety of structures.

BACKGROUND OF THE INVENTION

Support brackets may be used in conjunction with pieces of dimensional lumber to form a number of structures. For example, U.S. Pat. No. 4,502,565 issued Mar. 5, 1985 discloses a support bracket, two of which may be releasably attached to pieces of dimensional lumber to form a variety of four-legged structures, such as work benches, tables, saw horses, scaffolds etc. Each bracket has a pair of opposed, generally upright sockets. A piece of dimensional lumber is passed through each of the four upright sockets of the two brackets, and a single spring-loaded clamp secures each piece of lumber in place to form the legs of the structure. The horizontal displacement between the tops of the upright sockets may be adjusted, and one or more planks are laid atop the opposed pair of brackets.

Similarly, U.S. Pat. No. 5,020,634 issued Jun. 4, 1991 discloses an improved support bracket. The support bracket further comprises two brace members with a right-angled Z shape to brace the sides of one or more planks laid atop the support brackets. The shape of the brace members is intended to increase the torsional strength of the brace members. The brace members are further notched to straddle the generally horizontal sockets of the support bracket. The horizontal sockets are interconnectible and may receive opposed ends of a wood extension member.

The devices of U.S. Pat. Nos. 4,502,565 and 5,020,634 have a number of shortcomings. For example, although a piece of dimensional lumber is secured to each of the upright sockets using a spring-loaded clamp to form a leg of the structure, this clamp can unexpectedly fail if the leg is kicked or otherwise impacted. This can result in the leg sliding within the upright socket, destabilizing the entire structure.

The present invention provides an improved support bracket that overcomes this and other shortcomings of the prior art.

SUMMARY OF THE INVENTION

The invention provides a work bench support bracket comprising first and second opposed, generally upright sockets, first and second interconnectible, generally horizontal sockets joined to the first and second generally upright sockets, respectively, and first and second clamping sets joined to the first and second generally upright sockets, respectively. The first and second clamping sets each comprise an upper releasable clamp and a fixed lower brace member.

In one aspect of the invention, the upper releasable clamp comprises a grip pivotably attached to each of the generally upright sockets, with the grip resiliently urged in an upward position, a connector, with one end of the connector attached to the grip, a joint pivotably attached to another end of the connector, and a handle pivotably attached to the joint.

In a further aspect of the invention, the rotation of the handle with respect to the connector about the joint is limited. The connector's length may also be less than the handle's length.

In another aspect of the invention, the upper releasable clamp comprises a grip pivotably attached to each of the generally upright sockets at an axis of rotation, with the grip resiliently urged in an upward position, a handle pivotably attached to each of the generally upright sockets at the axis of rotation, and a stopper attached to the handle for limiting rotation of the handle with respect to the grip.

In yet another aspect of the invention, each of the generally horizontal sockets comprises two sides walls, each of the side walls of the first generally horizontal socket comprises one or more first horizontal indentations, and each of the side walls of the second generally horizontal socket comprises one or more second horizontal indentations.

In another aspect of the invention, the first horizontal indentations slide within the second horizontal indentations when the first and second generally horizontal sockets interconnect.

In one aspect of the invention, one of the side walls of the first horizontal socket comprises an aperture and a corresponding one of the side walls of the second horizontal socket comprises a pull pin.

The foregoing was intended as a broad summary only and of only some of the aspects of the invention. It was not intended to define the limits or requirements of the invention. Other aspects of the invention will be appreciated by reference to the detailed description of the preferred embodiment and to the claims.

BRIEF DESCRIPTION OF THE DRAWINGS

The invention will be described by reference to the detailed description of the preferred embodiment and to the drawings thereof, in which.

DETAILED DESCRIPTION OF THE PREFERRED EMBODIMENT

Figure 1:
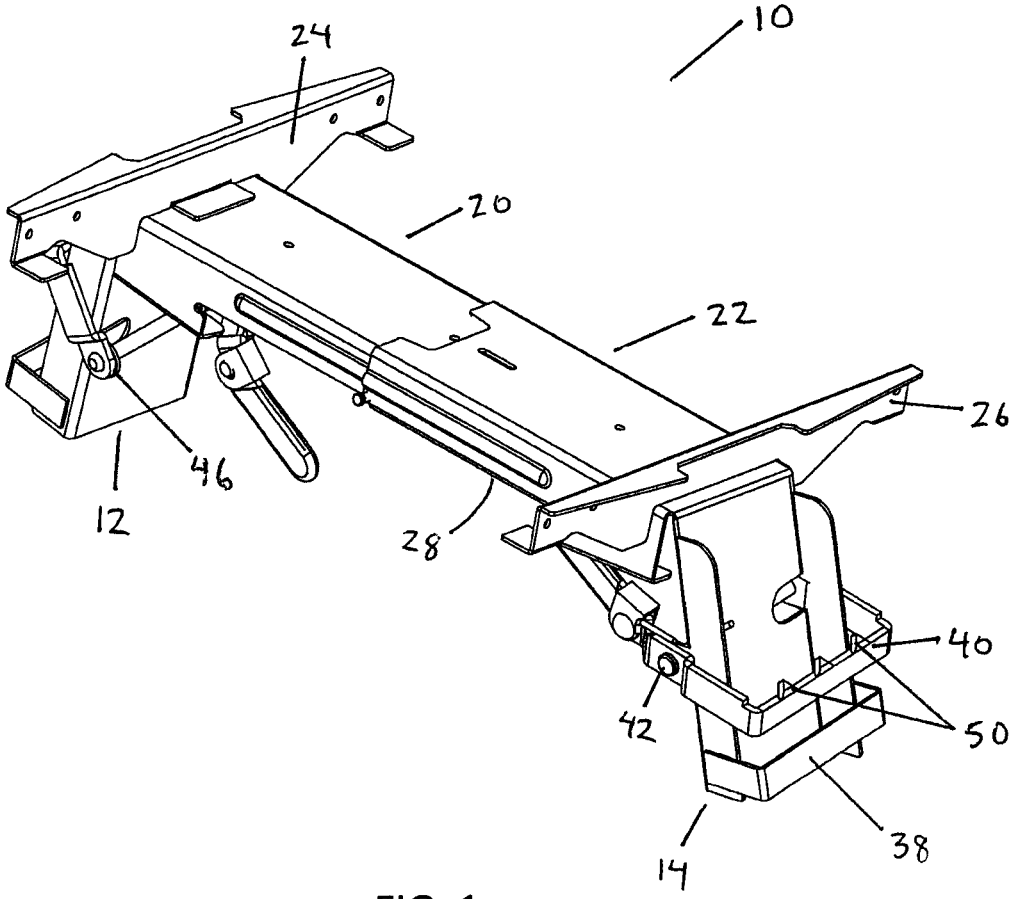
FIG. 1 is a top perspective view of a work bench support bracket in accordance with the preferred embodiment of the invention.
Figure 2:
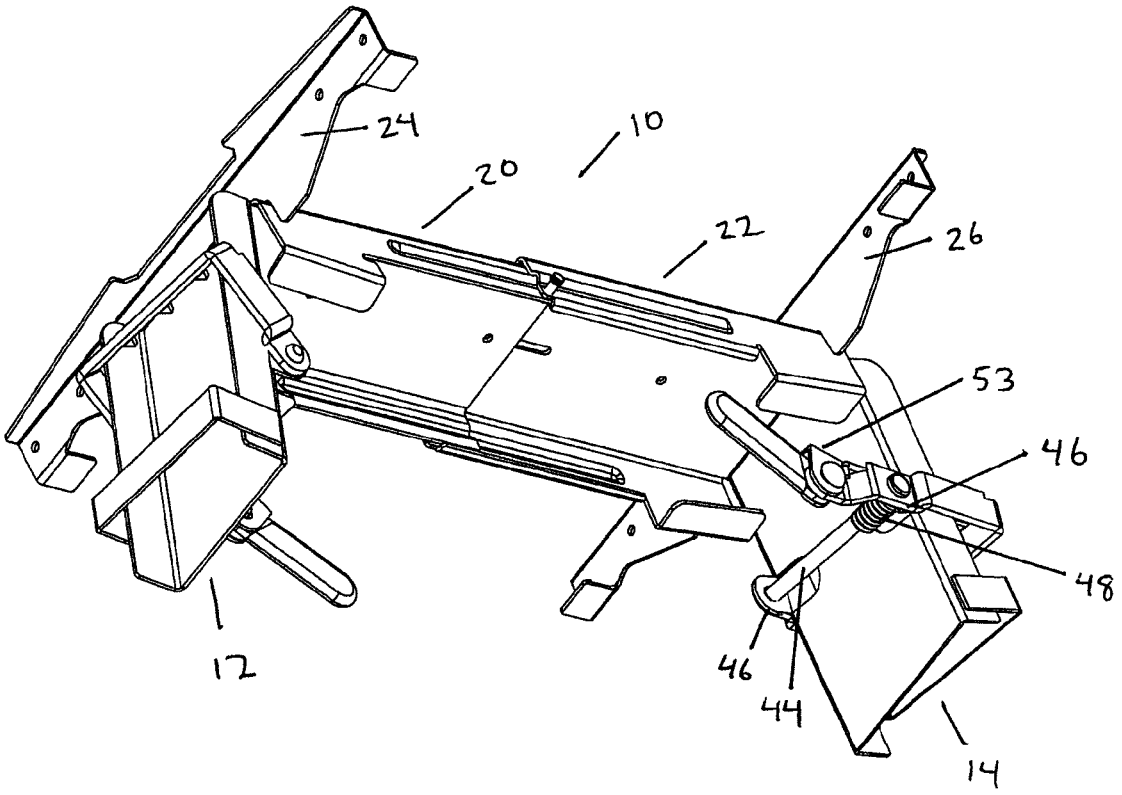
FIG. 2 is a bottom perspective view of the work bench support bracket.

Referring to FIGS. 1 and 2, a work bench support bracket 10 in accordance with the preferred embodiment comprises first and second opposed, generally upright sockets 12, 14 for receiving first and second leg members 16, 18 (which may be cut from readily available 2"×4" lumber). Joined to, and extending generally perpendicular to the generally upright sockets 12, 14 are first and second telescopically interconnectible, generally horizontal sockets 20, 22 for optionally receiving opposed ends of an extension member 28 (which may also be cut from 2"×4" lumber). The work support bracket 10 further comprises first and second upwardly extending end members 24, 26 projecting transversely atop the generally horizontal sockets 20, 22 respectively to brace the sides of one or more planks 30 laid atop the generally horizontal sockets 20, 22 (and atop any extension member 28 placed between the generally horizontal sockets 20, 22) to form a working surface.

Figure 7:
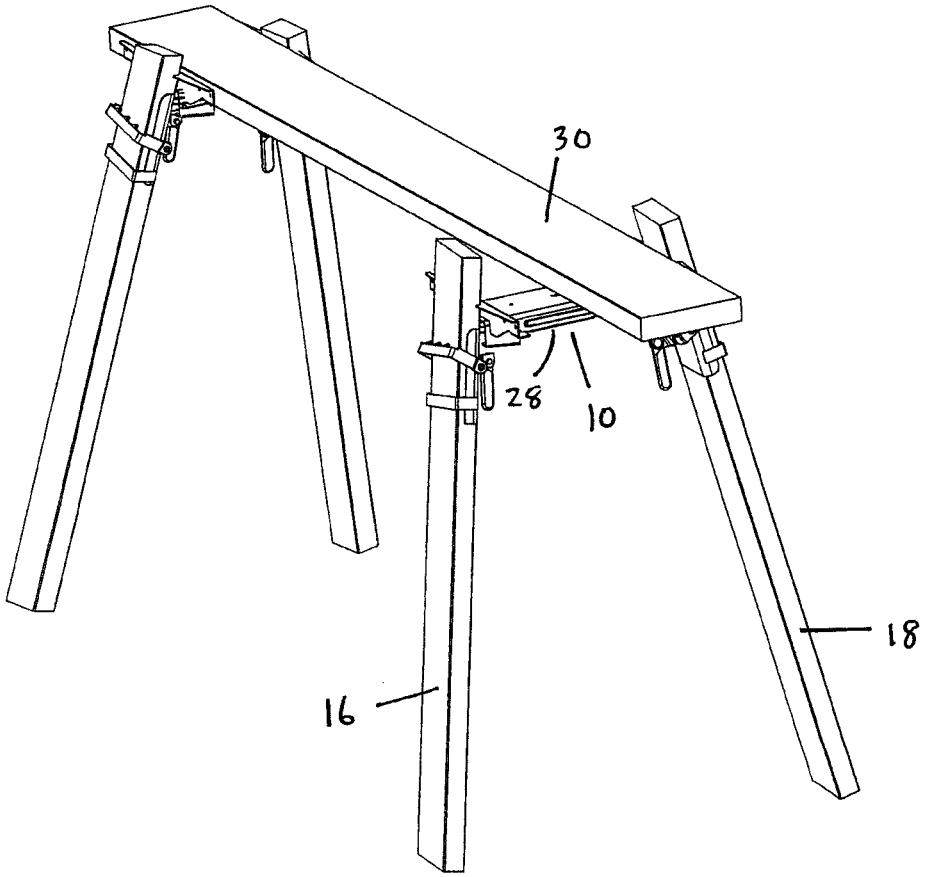
FIG. 7 is a view of the work bench support bracket with wood members connected.

A pair of work bench support brackets 10 may be used to form a variety of four-legged structures, such as work benches, tables, saw horses, scaffolds or the like, as generally shown in FIG. 7.

The work bench support bracket 10 further comprises first and second sets of releasable clamps 32, 34 for releasably securing the first and second leg members 16, 18 within the generally upright sockets 12, 14 respectively. Each of the two sets of releasable clamps 32, 34 comprises an upper clamp 36 and a fixed lower brace 38. The clamp 36 comprises a grip 40 extending from a pivotal mounting 42 on a shaft 44 pivotally engaged in lugs 46 on the generally upright sockets 12, 14. The grip 40 is generally U-shaped and extends around the front of the generally upright sockets 12, 14. The grip 40 is urged to its upward position, in which it grips leg members 16, 18, by a spring 48 provided at one of the lugs 46. The grip 40 may further comprise teeth 50 to facilitate gripping of the leg members 16, 18.

Figure 6:
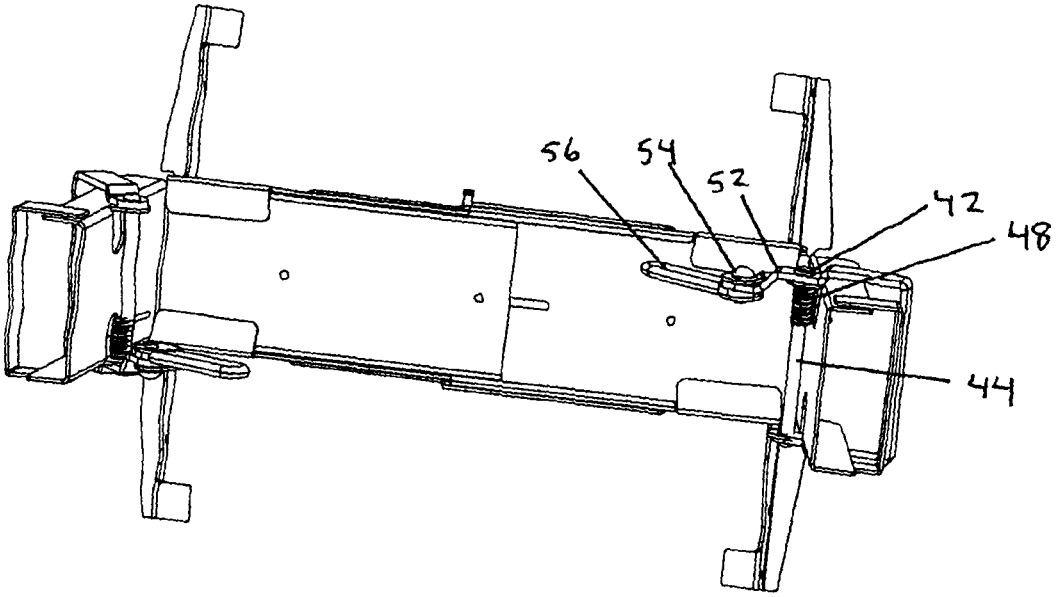
FIG. 6 is a bottom view of the work bench support bracket.

As best shown in FIG. 6, one end of a connector 52 extends inwardly from the pivotal mounting 42. The other end of the connector 52 is pivotably attached to a joint 54. The joint 54 may be formed using a rivet or some other appropriate connection mechanism. In one embodiment, the ends of the connector 52 are in a staggered configuration, such that the joint 54 is closer to the longitudinal middle of the shaft 44 than the pivotal mounting 42. A handle 56 is also pivotably attached to the joint 54 and extends further inwardly. The handle 56 and the connector 52 are able to rotate relatively freely about the joint 54 to a maximum angle. In one embodiment, this maximum angle is approximately 220°, although other maximum angles may also be possible. Further rotation is prevented by the presence of a limiter or stopper 53 in the joint 54. The degree of the freedom of rotation of the handle 56 should be such that, when the first and second leg members 16, 18 are not present, the handle does not impede placement of the generally upright sockets 12, 14 on a flat surface to better facilitate assembly and disassembly. The length of the handle 56 should be greater than the length of the connector 52. Because of the staggered configuration of the connector 52 the handle 56 lies substantially underneath the horizontal sockets 20, 22. In the embodiment shown in FIG. 6, the spring 48 is located on the end of the spring 44 closest to the handle 56.

The brace 38 is generally U-shaped and extends around the front of the generally upright sockets 12, 14. The brace 38 may be attached to the generally upright sockets 12, 14 by welding, although other fastening mechanisms may be used as well. The brace 38 may also comprise teeth (not shown) to facilitate gripping of the leg members 16, 18. In another embodiment, the brace 38 may be integrally formed with the side walls of the generally upright sockets 12, 14. In yet another embodiment, the brace 38 need not span the entire width of the generally upright sockets 12, 14. The brace 38 provides a secondary surface of contact to the leg members 16, 18.

Operation of the sets of releasable clamps 32, 34 will now be described. In particular, operation of the first set of releasable clamps 32 will be described, although it is to be understood that the second set of releasable clamps 34 operates in a similar manner. When at rest, the grip 40 is urged to its upwind position because of the spring 48. As a result, the connector 52 extends at an angle downwardly from the pivotal mounting 42. Because of the joint 54 and the effect of gravity, the handle 56 will extend substantially vertically downward from the joint 54.

In order to insert the first leg member 16 into the first generally upright socket 12, the grip 40 must be positioned away from its upward position in order to allow the first leg member 16 to slide into place within the first generally upright socket 12. In order to do so, the handle 56 is moved upward from its substantially vertical position. As it is moved upward, the handle 56 rotates about the joint 54 until the angle between the handle 56 and the connector 52 reaches approximately 220°, at which time further rotation about the joint 54 is prevented. Further upward movement of the handle 56 will now cause the connector 52 to rotate upwards (with respect to the pivotal mounting 42), which in turn results in the grip 40 rotating downwards with respect to the pivotal mounting 42) against the spring 48. When the grip 40 has moved sufficiently away from its upward position, the first leg member 16 may be inserted into the first generally upright socket 12. The first leg member 16 will also slide within the brace 38.

After the first leg member 16 is in place within the first generally upright socket 12, the handle 56 may be released. The spring 48 urges the grip 40 back towards its upward position. The teeth 50 on the grip 40 will contact the side of the first leg member 16 and hold it in place within the first generally upright socket 12. As the grip 40 moves back towards its upward position, the connector 52 will rotate downward about the pivotal mounting 42. The handle 56 will also rotate downward about the joint 54 and will again assume a substantially vertical position.

If the first leg member 16 is to be removed from the first generally upright socket 12, the handle 56 is again moved upward from its substantially vertical position. As it is moved upward, the handle 56 rotates about the joint 54 until the angle between the handle 56 and the connector 52 reaches approximately 220°, at which time further rotation about the joint 54 is prevented. Further upward movement of the handle 56 will now cause the connector 52 to rotate upwards (with respect to the pivotal mounting 42), which in turn results in the grip 40 rotating downwards (with respect to the pivotal mounting 42) against the spring 48 and losing contact with the side of the first leg member 16. When the grip 40 has moved sufficiently away from its upward position, the first leg member 16 may be slid out of the brace 38 and out of the first generally upright socket 12.

The presence of the joint 54 causes the handle 56 to rotate downward to a substantially vertical position when the sets of releasable clamps 32, 34 are at rest. This makes it more difficult for a person to accidentally knock the handle 56 and cause the grip 40 to unexpectedly release the leg members 16, 18 from the generally upright sockets 16, 18. In order to do so would require rotation of the handle 56 sufficient to achieve an approximately 220° angle with the connector 52, plus a further rotation about the pivotal mounting 42. This would be difficult to do with an accidental impact on the handle 56. Because of the relative lengths of the handle 56 and the connector 52, in order to move the grip 40 using only the connector 52 (without the assistance of the handle 56) would require a great deal of torque. Furthermore, because the handle 56 is located substantially underneath the horizontal sockets 20, 22, there is less likelihood of an accidental impact on the handle 56.

The presence of the brace 38 provides an additional surface of contact and provides additional safety. Without the brace 38, the leg members 16, 18 would be held in place against the generally upright sockets 12, 14 by the grip 40 only. However, any accidental impact on the leg members 16, 18 could result in the leg members 16, 18 shifting or rotating about the grip 40. This may result in the associated structure collapsing. By having a brace 38, the likelihood of such movement is reduced, since the brace 38 provides an additional surface of contact, with additional stability.

Figure 8:
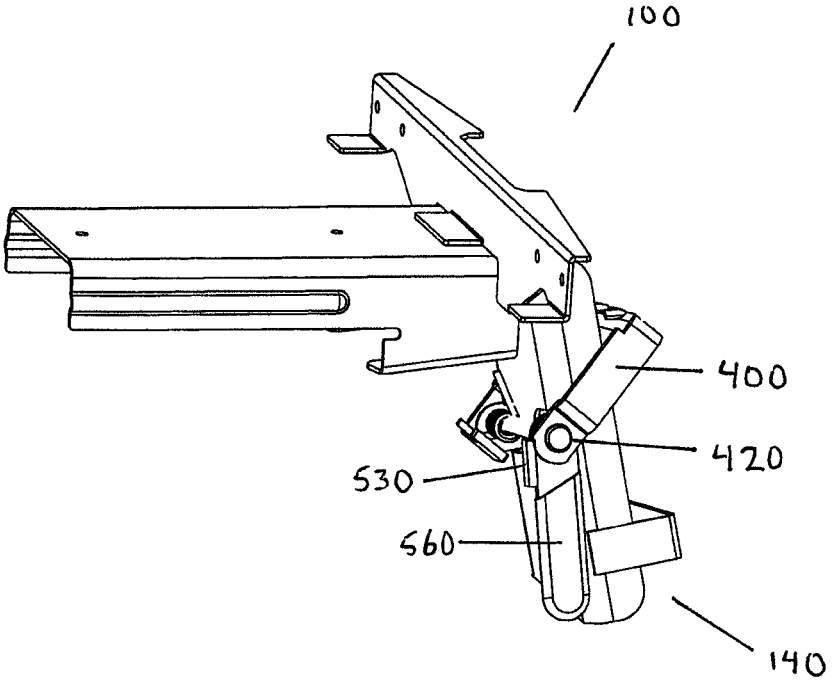
FIG. 8 is a perspective view of a second embodiment of a portion of the work bench support.
Figure 9:
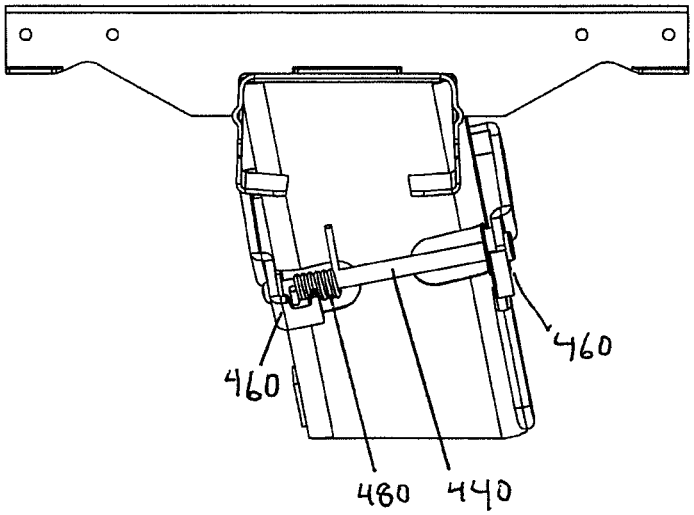
FIG. 9 is a side view of the second embodiment of a portion the work bench support bracket.

Referring to FIGS. 8 and 9, in an alternative embodiment the connector 52 is not used. Instead, in support bracket 100, grip 400 extends from pivotal mounting 420 on shaft 440 pivotally engaged in lugs 460 on generally upright sockets 120, 140. The grip 400 is urged to its upward position, in which it grips leg members by a spring 480. Handle 560 is pivotably attached to pivotal mounting 420 and is able to rotate about the pivotal mounting 420 with respect to the grip 400. Stopper 530 attached to the handle 560 limits the maximum amount of rotation. In this embodiment, spring 480 is located on the shaft 440 on the opposite end as the handle 560. FIGS. 8 and 9 show half of the support bracket 100, but the other half would be substantially a mirror image.

Figure 3:
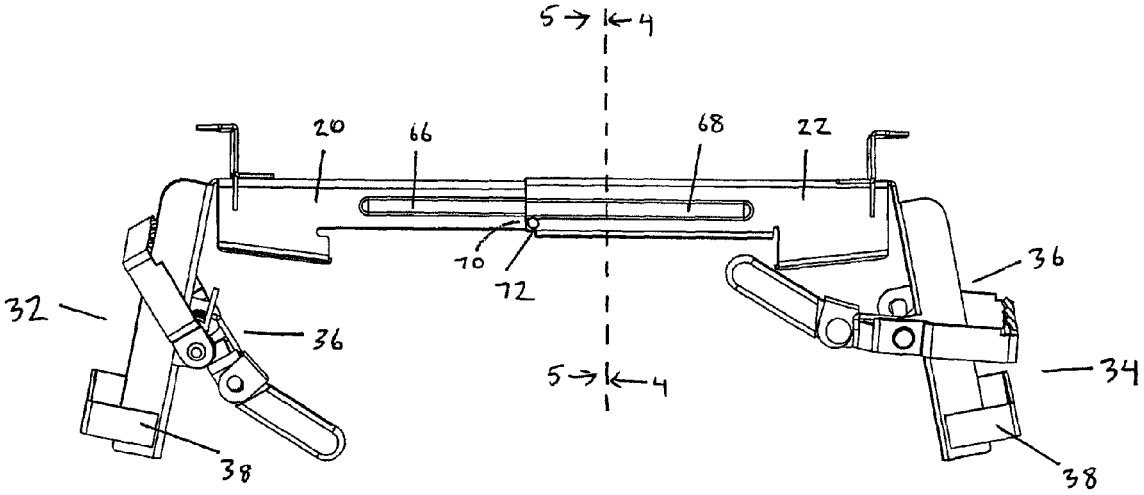
FIG. 3 is a side view of the work bench support bracket.
Figure 4:
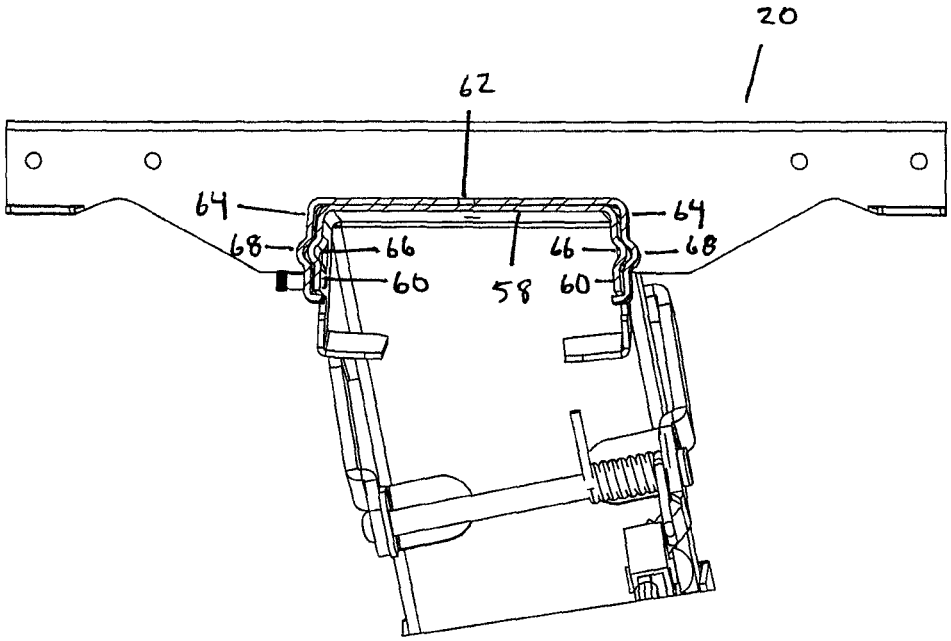
FIG. 4 is a cross-sectional view taken with respect of line 4-4 of FIG. 3.
Figure 5:
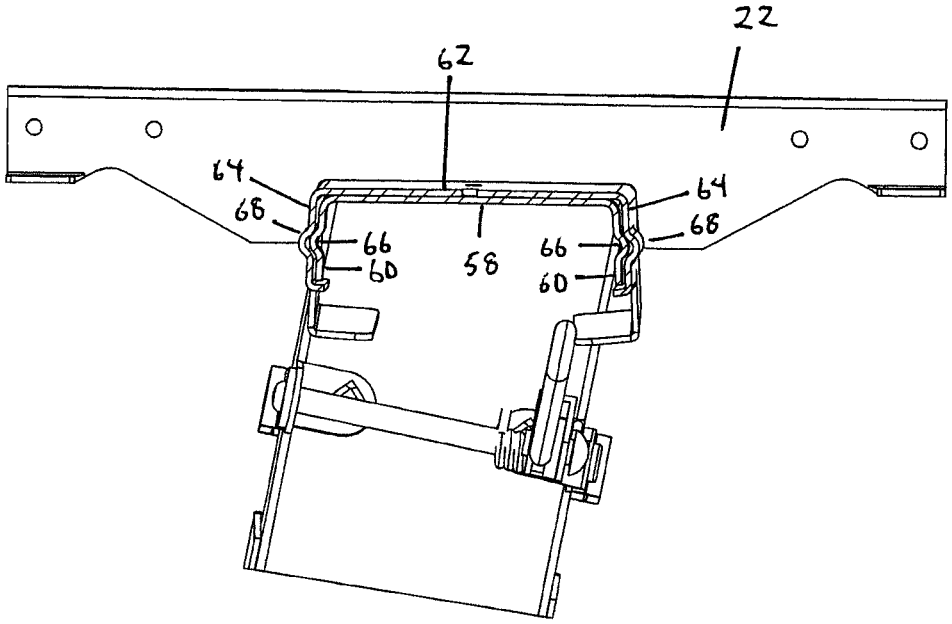
FIG. 5 is a cross-sectional view taken with respect of line 5-5 of FIG. 3.

Referring to FIGS. 3 to 5, the first horizontal socket 20 comprises a first upper surface 58 and first vertical surfaces 60. The second horizontal socket 22 comprises a second upper surface 62 and second vertical surfaces 64. The first vertical surfaces 60 of the first horizontal socket 20 comprise one or more first horizontal indentations 66. One or more aligned and corresponding second horizontal indentations 68 are formed on the second vertical surfaces 64 of the second horizontal socket 22 such that the first horizontal indentations 66 slide within the second horizontal indentations 68 when the first horizontal socket 20 and the second horizontal socket 22 telescope, as best shown in FIGS. 4 and 5. In FIGS. 3 to 5, each of the first vertical surfaces 60 has one first horizontal indentation 66, and each of the second vertical surfaces 64 has one second horizontal indentation 68.

The horizontal indentations 66, 68 may be formed by stamping and may extend either for a substantial portion of the length of the horizontal sockets 20, 22. In FIGS. 3 to 5, the horizontal indentations 66, 68 extend from the open end of the horizontal sockets 20, 22. Each of the horizontal indentations 66, 68 has a convex portion on one side and a corresponding concave portion on the other side of the vertical surfaces 60, 64 of the horizontal sockets 20, 22. The horizontal indentations 66, 68 serve to increase the strength and rigidity of the horizontal sockets 20, 22, both alone and when telescopically connected.

As discussed above, the horizontal sockets 20, 22 telescope and may slide within one another. An aperture 70 is provided on one of the vertical surfaces 60 of the first horizontal socket 20. A pull pin 72 is provided on the corresponding vertical surface 64 of the second horizontal socket 22. When the horizontal sockets 20, 22 telescope and when the aperture 70 is aligned with the push pin 72, the pull pin 72 will be biased toward its extended position, at which time it will pass through the aperture 70. This prevents any further movement of the horizontal sockets 20, 22 with respect to each other and locks their positions in place. The pull pin 72 can be deactivated by pulling on it in order to allow the horizontal sockets 20, 22 to again telescope.

It will be appreciated by those skilled in the art that the preferred embodiment has been described in some detail but that certain modifications may be practiced without departing from the principles of the invention.

The invention claimed is:

1. A work bench support bracket comprising:

first and second opposed, generally upright sockets;

first and second interconnectible, generally horizontal sockets joined to said first and second generally upright sockets, respectively; and first and second clamping sets joined to said first and second generally upright sockets, respectively, wherein each of said first and second clamping sets comprises:

an upper releasable clamp; and a fixed lower brace member entirely spaced from and positioned below said upper releasable clamp;

wherein said upper releasable clamp comprises a handle pivotally connected to a grip, the grip being pivotally mounted with respect to a respective one of the generally upright sockets and resiliently urged toward a position at rest, the upper releasable clamp being configured to:

permit the handle to rotate, relative to the grip stationary in the position at rest, in a direction moving from a first position toward a second position, wherein further rotation of the handle, with respect to the grip, toward said direction is limited when the handle is in the second position; and permit the handle, when in the second position, to rotate in unison with the grip in said direction to be further away from the first position, thereby causing the grip to rotate in said direction away from the position at rest;

wherein the first upright socket, a first upper clamp of said upper releasable clamps, and a first lower brace member of said fixed lower brace members are collectively configured to releasably receive and fixedly secure a first leg;

wherein the second upright socket, a second upper clamp of said upper releasable clamps, and a second lower brace member of said fixed lower brace members are collectively configured to releasably receive and secure a second leg; and wherein the work bench support bracket is configured to be one of a pair of identical work bench support brackets configured to support a single horizontal plank on the horizontal sockets of the pair of identical work bench support brackets as each of said pair of identical work bench support brackets secures said first and second legs to form a four-legged work bench.

2. The work bench support bracket of claim 1, wherein one of said upper releasable clamps comprises:

the grip pivotably attached to the respective one of the generally upright sockets at a first axis of rotation;

a connector, wherein one end of said connector is attached to said grip at the first axis of rotation and wherein another end of said connector extends away from the first axis of rotation; and the handle pivotably attached to said another end of said connector at a second axis of rotation.

3. The work bench support bracket of claim 1, wherein one of said upper releasable clamps comprises:

the grip pivotably attached to the respective one of the generally upright sockets at an axis of rotation;

a handle pivotably attached to the respective one of the generally upright sockets at said axis of rotation; and a stopper attached to said handle for limiting rotation of said handle with respect to said grip.

4. The work bench support bracket of claim 2, wherein each of said upper releasable clamps is configured such that a free rotation of said handle with respect to said connector about said second axis of rotation is limited to thereby limit the free rotation of the handle relative to the grip.

5. The work bench support bracket of claim 4, wherein each of said upper releasable clamps is configured such that said free rotation of the handle is limited to a maximum of approximately 220°.

6. The work bench support bracket of claim 2, wherein a longitudinal length of said connector is less than a longitudinal length of said handle.

7. The work bench support bracket of claim 2, wherein said handle and connector are connected via a rivet at the second axis of rotation.

8. The work bench support bracket of claim 2, wherein said ends of said connector are staggered.

9. The work bench support bracket of claim 8, wherein said handle lies substantially underneath said generally horizontal sockets.

10. The work bench support bracket of claim 2, wherein said grip is resiliently urged in an upward position by a spring.

11. The work bench support bracket of claim 2, wherein said grip comprises a plurality of teeth.

12. The work bench support bracket of claim 1, wherein the handle is configured to rotate downward to a substantially vertical position when the grip is at the position at rest and the generally upright sockets are in an upright position for use.

13. The work bench support bracket of claim 1, wherein said brace member is welded to a respective one of each of said generally upright sockets.

14. The work bench support bracket of claim 1, wherein:

each of said generally horizontal sockets comprises two side walls;

each of said side walls of said first generally horizontal socket comprises one or more first horizontal indentations; and each of said side walls of said second generally horizontal socket comprises one or more second horizontal indentations.

15. The work bench support bracket of claim 14, wherein said side walls are substantially vertical.

16. The work bench support bracket of claim 14, wherein said first horizontal indentations slide within said second horizontal indentations when said first and second generally horizontal sockets interconnect.

17. The work bench support bracket of claim 14, wherein said first and second horizontal indentations are formed by stamping.

18. The work bench support bracket of claim 14, wherein said first and second horizontal indentations extend from one end of said first and second horizontal sockets, respectively.

19. The work bench support bracket of claim 14, wherein:

one of said side walls of said first horizontal socket comprises an aperture; and a corresponding one of said side walls of said second horizontal socket comprises a pull pin.

* * * * *